United States Patent [19]

Engler

[11] 4,031,951

[45] June 28, 1977

[54] AIR CLIMATIZING DEVICE

[75] Inventor: Peter Engler, Mosbach, Germany

[73] Assignee: Luwa AG, Zurich, Switzerland

[22] Filed: Nov. 13, 1974

[21] Appl. No.: 523,549

[30] Foreign Application Priority Data

Nov. 21, 1973 Switzerland ..... 16447/73

[52] U.S. Cl. ..... 165/103; 165/96; 165/35; 137/601; 137/609

[51] Int. Cl.[2] ..... G05D 23/00; F28F 27/02

[58] Field of Search ..... 165/103, 96, 123, 36; 251/248, 250.5, 298; 137/601, 607, 609, 595

[56] References Cited

UNITED STATES PATENTS

| | | | |
|---|---|---|---|
| 2,522,860 | 9/1950 | Conaway | 165/96 X |
| 2,694,497 | 11/1954 | Stock | 251/250.5 X |
| 3,139,020 | 6/1964 | Schemenauer | 165/96 X |
| 3,212,424 | 10/1965 | Davis | 165/96 X |
| 3,433,295 | 3/1969 | Avery | 165/103 X |
| 3,470,945 | 10/1969 | Schmidt | 165/123 X |
| 3,512,578 | 5/1970 | Honmann | 165/26 |
| 3,650,318 | 3/1972 | Avery | 165/103 |
| 3,771,559 | 11/1973 | Alley | 137/601 |
| 3,841,398 | 10/1974 | Serratto | 165/123 |
| 3,847,210 | 11/1974 | Wells | 165/103 |
| 3,911,953 | 10/1975 | Crombie et al. | 137/607 X |

FOREIGN PATENTS OR APPLICATIONS

| | | | |
|---|---|---|---|
| 611,360 | 10/1960 | Italy | 165/103 |
| 1,211,137 | 11/1970 | United Kingdom | 165/123 |

*Primary Examiner*—Albert W. Davis, Jr.
*Assistant Examiner*—Ira S. Lazarus
*Attorney, Agent, or Firm*—Werner W. Kleeman

[57] ABSTRACT

An air climatizing or conditioning device possessing a plurality of flaps controlling air through passages and an adjustment or positioning motor and transmission means in order to actuate such flaps in a predetermined sequence. The transmission means comprising gears as well as entrainment elements or members cooperating therewith at predetermined regions, the entrainment elements being operatively drivingly connected with the flaps so as to be non-rotatable relative to their associated flaps in a predetermined position of each entrainment element.

15 Claims, 4 Drawing Figures

AIR CLIMATIZING DEVICE

BACKGROUND OF THE INVENTION

The present invention relates to a new and improved construction of an air climatizing device or air conditioning device of the type incorporating a multiplicity of flaps which control air throughpassages as well as an adjustment or positioning motor and transmission means in order to actuate the flaps in a predetermined sequence.

According to a prior art construction of a device of this type designed as an induction climatizing device the flaps are connected with a common thrust motor through the agency of a respective lever and a respective thrust rod. The levers are connected via clamp connections with the flaps and their axes of rotation. During the assembly of the device the flaps and clamp levers must be adjusted and thereafter the clamp connections tightened, operations which require a relatively great amount of time. In spite of this there is not ensured that the flap movement will occur in the intended sequence within the stroke which is available at the thrust motor.

SUMMARY OF THE INVENTION

It is a primary object of the present invention to overcome the aforementioned drawbacks and to provide a new and improved construction of air climatizing device wherein in any event the desired sequence of the movements of the flaps is ensured for and the assembly of the drive can proceed rapidly and simply.

Now in order to implement this object and others which will become more readily apparent as the description proceeds, the invention contemplates that the transmission means comprise gears as well as entrainment elements cooperating therewith at predetermined locations or regions, and such entrainment elements are rigidly connected against rotation with the flaps i.e. operatively drivingly connected for non-relative rotational movement with their associated flap.

The advantages of the invention, among others, reside in the features that the desired sequence of the flap movements is the same for all devices by virtue of the gears and during operation cannot readjust itself, that the drive can be assembled quickly and simply and fabricated economically. Further, through the use of the gears it is possible in a very simple manner for the drive to also employ an adjustment or postioning motor with rotational movement instead of thrust motion. Especially with the electrical constructional manifestation a motor having rotational movement is less expensive than a thrust motor. Consequently, the flap drive in the case of small air climatizing installations can be constructed more economically electrically instead of pneumatically. Additionally, it is possible to drive the flaps of a number of devices through a single adjustment or positioning motor.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
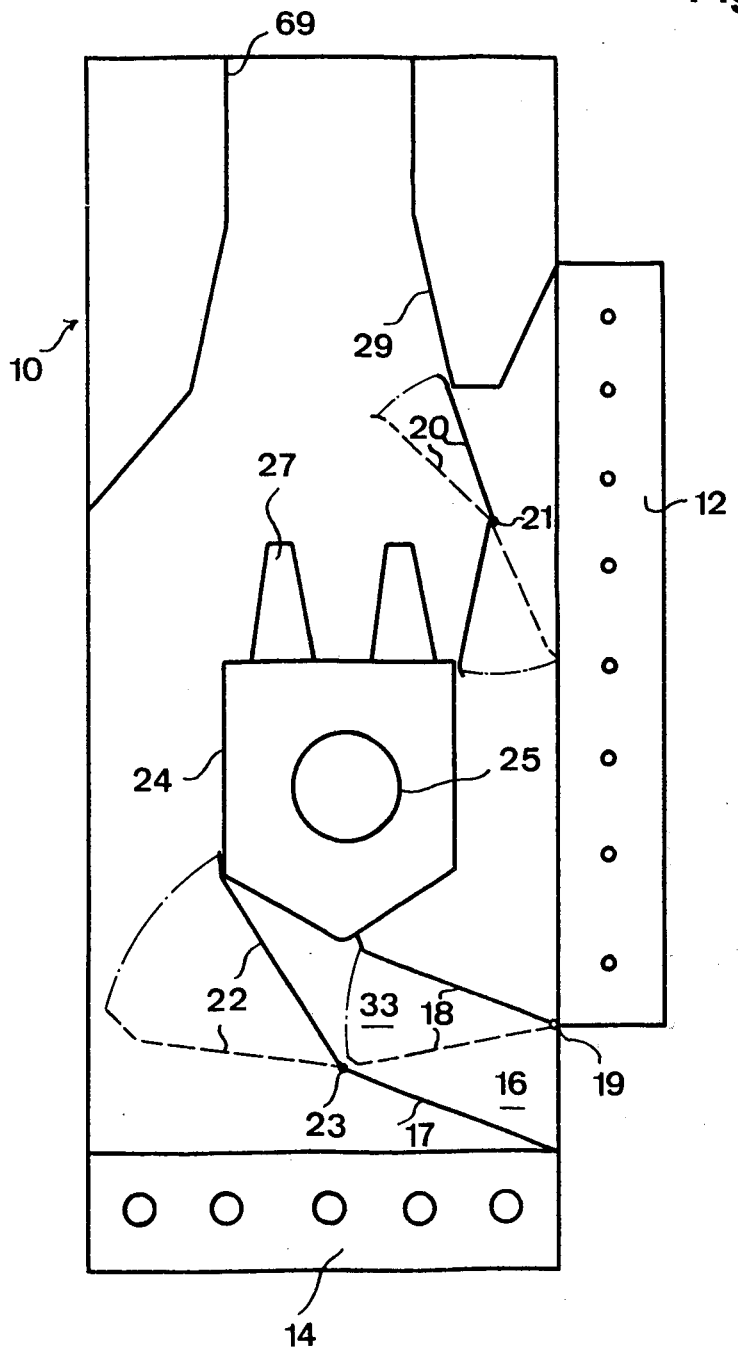
FIG. 1 is a sectional view through an induction climatizing device or air conditioning device as contemplated by the invention.

Describing now the drawings, reference numeral 10 designates the housing of an induction climatizing device which possesses two heat exchangers 12 and 14 arranged in angular spaced relationship with respect to one another and a by-pass or inlet opening 16 for untreated or raw secondary air. The by-pass or inlet opening 16 is arranged between the heat exchangers 12, 14 as shown. A primary air compartment 24 is located at the central region of the housing 10 and connected by a tube or pipe 25 with an air preparation installation. The upper portion of the primary air compartment 24 possesses in cross-section a trapezoidal configuration and carries nozzles 27. The central located position of the primary air compartment 24 renders possible that the secondary air which selectively enters through one of both heat exchangers 12 and 14 respectively, and/or the by-pass opening 16 can flow at all sides about the primary air compartment 24, resulting in a high degree of induction.

The heat exchanger 14 is located horizontally in the lower portion of the housing 10 and is connected to a hot water supply network. The heat exchanger 14 furthermore possesses a flap or flap member 22 which is rotatably mounted at its one end about a shaft or axle 23. Shaft 23 is arranged at the free end of a guide member 17, for instance a sheet metal guide, which extends inwardly at an inclination from the right-hand inner corner of the heat exchanger 14. The flap member 22 in its one terminal or end position closes the outlet or efflux out of the heat exchanger 14 and for this purpose bears against a wall of the housing 10. In its other end or terminal position the flap member 22 bears at the primary air compartment 24 and consequently closes the by-pass opening 16.

The heat exchanger 12 is arranged vertically at the front wall of the housing 10 and is connected to a cold water supply network. This heat exchanger 12 possesses two flaps or flap members 18 and 20 which are arranged to be rotatable about the shafts or axles 19 and 21 respectively. The shaft 19 is arranged at one end of the flap member 18 and at the region of the inner lower corner of the heat exchanger 12. This flap or flap member 18 partially closes in its one end position the outlet of the heat exchanger 12 associated therewith and for this purpose bears at the primary air compartment 24. In the other end or terminal position the flap member 18 frees the outlet of the heat exchanger 12 and blocks the opening 16 and thus bears at the flap or flap member 22 of the heat exchanger 14.

The shaft or axle 21 is arranged at the central portion of the flap member 20. This flap member 20 in its one end position closes the outlet of the heat exchanger 12 associated therewith and for this purpose bears with one leg at the primary air compartment 24, with the other leg at a guide member 29, for instance a sheet metal guide plate, which deflects the flow into the interior of the housing. In its other end position the flap member 20 is located centrally of the flow of the secondary air emanating from the upper portion of the heat exchanger 12. In order to exhibit as low as possible flow resistance the flap member 20 is thus appropriately flexed or angled.

When both flap members 18, 22 bear against the primary air compartment 24 then there is produced therebetween an air cushion 33 which serves as an insulation between the hot air pillow and cold air pillow respectively, which form about the heat exchangers 12, 14. The flap member 22 additionally can be specially insulated.

When the flap members 18, 20 close the efflux out of the heat exchanger 12 then by means of the coupling of all flaps, as the same will be described more fully hereinafter, it is possible for the flap member 22 to assure each random or optional position. When the flap member 22 closes the efflux out of the heat exchanger 14 then in corresponding manner the flap members 18, 20 can assume any random position.

Figure 2:
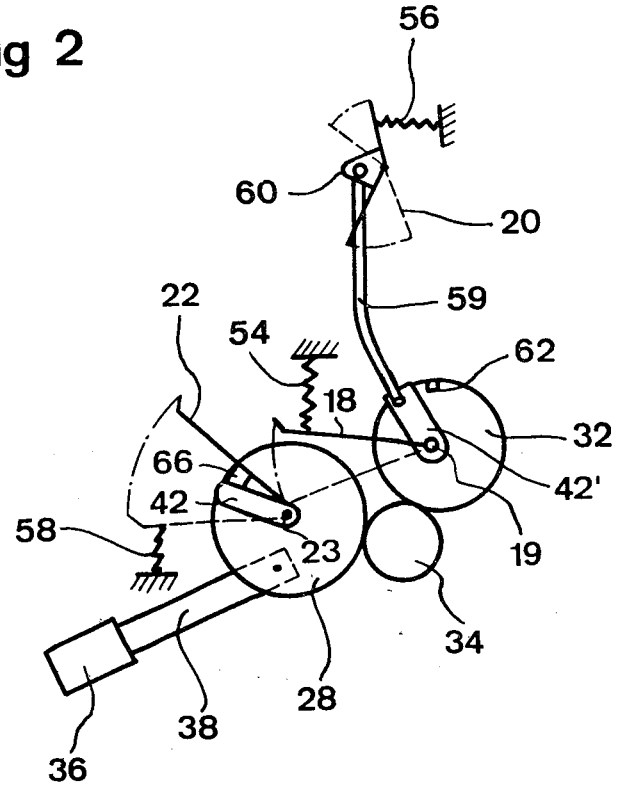
FIG. 2 is a schematic illustration of a drive for the induction climatizing device of FIG. 1.
Figure 4:
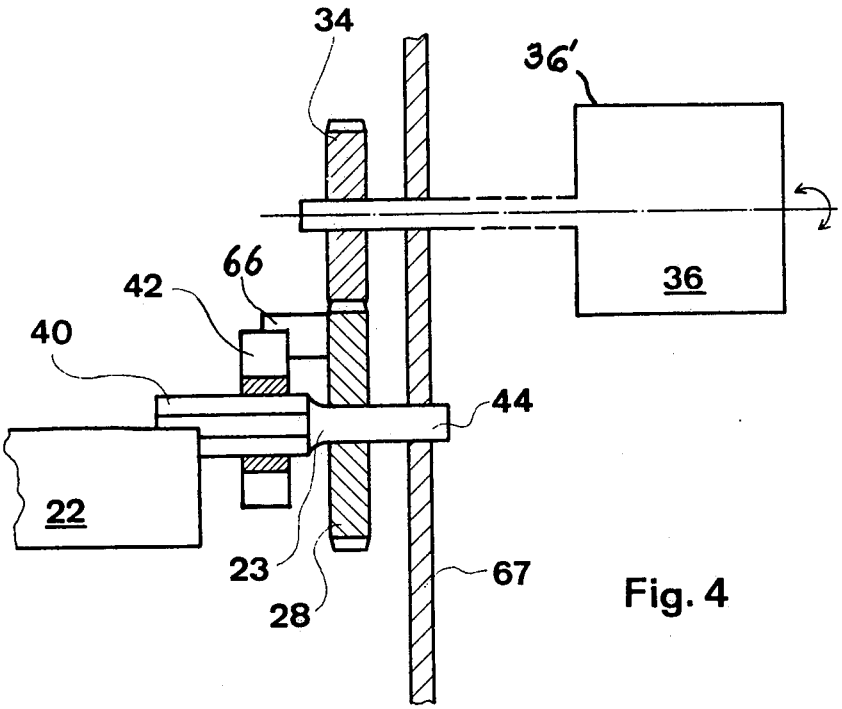
FIG. 4 illustrates a modified form of drive employing a rotary motor.

In FIG. 2 for the sake of clarity in illustration there has only been shown the flaps of the induction climatizing device portrayed in FIG. 1 and their drive. Rotatably mounted about the axes of rotation or shafts 19, 23 of the flap members 18, 22 is a respective gear 28 and 32. To simplify the showing of the drawing there are furthermore only illustrated of the gears the pitch circles. An intermediate gear 34 is in meshing engagement with the gears 28, 32 and likewise rotatably mounted in the housing. A servomotor 36 of the type constituting a thrust motor is drivingly connected via a thrust rod 38 with the gear 28. As will be further explained hereinafter motor 36 also may be a rotary motor 36' ,as shown in FIG. 4.

Figure 3:
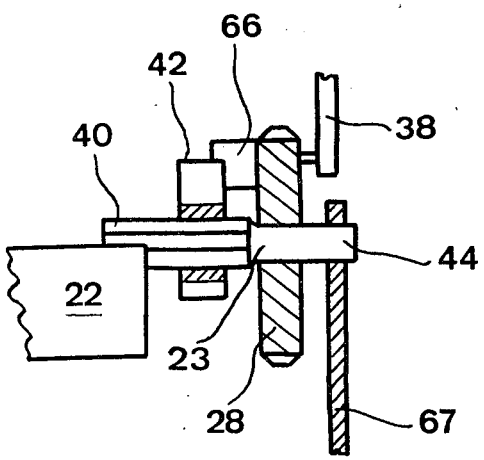
FIG. 3 is a detail of a flap - drive, and specifically illustrating the connection of a flap and gear.

As best seen by referring to FIG. 3 the flaps 18, 20, 22 possess axle journals 40 which according to a peferred embodiment are constructed of hexagonal configuration. Upon each of the hexagonal journals there is mounted a lever or a dog 42 which is internally provided with a hexagonal hole. The position of the lever 42 can thus be changed relative to the flap from 60° to 60° . The end portion 44 of the axle journal 40 which faces away from the flap member possesses a cylindrical cross-section and is rotatably mounted in a support 67. At the end portion 44 there is freely rotatably mounted the gear associated with such flap member. At each gear 28, 32 there is secured an entrainment member 66 and 62 respectively, which in certain positions of each gear comes into contact with the therewith associated levers 42, 42'. The other end of the flap member is mounted via a conventional pin or pivot journal in housing 10.

Each of the flap members or flaps 18, 20, 22 has associated therewith a spring 54, 56, 58 or equivalent element, which strives to retain the flaps in that position in which the outlet of the associated heat exchanger is closed. The flap 20 possesses a lever 60 which is fixedly connected therewith, and which is coupled via a rod 59 with the lever 42'.

The flap positions shown in full lines in FIG. 1 illustrate the total heating operation. The flap member 22 bears at the primary air compartment 24, thereby freeing the outlet from the heat exchanger 14 and closing-off the entry of untreated or raw secondary air through the by-pass opening 16. The flap members 18, 20 likewise bear at the primary air compartment 24 and the guide plate or member 29 respectively, and prevent the escape of cooled secondary air out of the heat exchanger 12.

If the heating output should be reduced, then the servomotor 36, under the influence of a conventional thermostat, displaces the thrust rod 38, with the result that the gear 28 begins to rotate in the counterclockwise direction. As a result the intermediate gear 34 and the gear 32 are driven, the latter also in counterclockwise direction. The entrainment member 66 of the gear 28 moves together with gear 28 in the counterclockwise direction. Under the influence of the spring 58 the lever 42 bears at the entrainment member 66 and the flap member slowly frees the by-pass opening 16. Consequently, untreated secondary air can enter into the housing 10, and the temperature at the air outlet 69 of the housing drops. When the flap member 22 completely bears at the housing 10 then no warm air can escape any longer out of the heat exchanger 14 which is still in operation. At the same time there is completely free the inlet opening 16 for the untreated or raw secondary air. The spring 58 holds the flap member 22 in the closed position so as to bear at the heat exchanger 14, whereas the entrainment member of the gear is distanced from its lever or dog.

If the exhaust temperature out of the air climatizing device should further sink, then the servomotor 36 further drives the gears 32, 38 and the intermediate gear 34. When the entrainment member 62 of the gear 32 comes into contact with the lever 42' of the flap member 18, then the entrainment member 62 via the lever 42' associated therewith presses the flap member 18, against the action of the spring 54, so as to slowly open. At the same time the flap member 20 is opened against the action of the spring 56 by the lever 42' via the rod 59 and the lever 60. In this way the outlet for cooled air out of the heat exchanger 12 is freed and at the same time by means of the flap member 18 there is prevented the throughpassage of untreated or raw secondary air through the by-pass opening 16.

Should the temperature at the outlet 69 of the housing drop further, then the flap members 18, 20 open further until finally the flap member 18 bears against the flap member 22 and no untreated secondary air can move any longer through the housing. The flap member 20 remains centrally disposed in the flow out of the upper portion of the heat exchanger 12. In this position, which has been illustrated by the broken line showing of the flaps in FIG. 1, the device or installation works with the total cooling output. During the entire operation now described all of the gears have continuously further rotated, yet the corresponding flap however only to such an extent as is possible by virtue of the entrainment member of the gear associated therewith.

The sequence of the movement of the flaps is governed by the gears, the position of the entrainment members at the gears, the form and position of the lever and must not be adjusted or tuned. The pressure region by-pass of the servomotor therefore remains the same size for all devices.

The arrangement of the heat exchangers 12, 20 in the housing 10 and the relative position of the heat exchangers to one another has no influence upon the basic construction of the drive.

Of course care should be taken that depending upon the constructional arrangement of the heat exchangers 12, 14 and the flaps or flap members 18, 20, 22 that such flaps rotate in the desired rotational sense. The flap member 20 of the heat exchanger 12 can also readily move in sequence with the flap member 18. Instead of a thrust motor it is also possible to provide a pneumatic or electric motor with limited angular rotation, as mentioned above and shown in FIG. 4 by reference character 36'. This adjustment motor 36' can drive either the gear 28, the gear 32 or the intermediate gear 34. In FIG. 4 the rotory adjustment motor 36' is seen to drive the intermediate gear 34'. In the event that a number of devices are to be controlled by a single servomotor 36, then the connection of the devices can be most advantageously realized by coupling the intermediate gear 34, the gear 32 or also the gear 28 directly driven by the servomotor 36 of neighbouring devices.

Basically, it is also possible to construct the flap actuation in the induction climatizing device of FIG. 1 so as to have a different drive than the gear drive illustrated in FIGS. 2 and 3.

While there is shown and described present preferred embodiment of the invention, it is to be distinctly understood that the invention is not limited thereto, but may be otherwise variously embodied and practiced within the scope of the following claims.

What is claimed is:

1. An apparatus for controlling the flow of air in an air climatizing device, comprising a housing having means defining air throughpassages, a plurality of flap members for controlling said air throughpassages, an adjustment motor and transmission means for actuating the flap members in a predetermined sequence, said transmission means comprising a plurality of relatively movable gears which are in continual power transmission-meshing engagement with one another during operation of the apparatus and entrainment elements cooperating with predetermined ones of said gears at predetermined regions thereof, means for drivingly connecting each entrainment element with each of its associated flap members in a respective position of each said entrainment element for positively driving each said associated flap member.

2. The apparatus as defined in claim 1, wherein said drivingly connecting means includes adjustable means for enabling adjustment of the point in time when each entrainment element drivingly acts upon its associated flap member.

3. The apparatus as defined in claim 1, wherein a first gear of said gears operatively cooperates with a first one of said flap members and a second gear of said gears operatively cooperates with a second one of said flap members.

4. The apparatus as defined in claim 3, said gears including an intermediate gear for placing both said first and second gears into driving engagement with one-another.

5. The apparatus as defined in claim 1, wherein the adjustment motor is a rotary motor having a limited range of angular rotation.

6. The apparatus as defined in claim 4, wherein the adjustment motor is a rotary motor having a limited range of angular rotation, and said rotary motor being in driving connection with the intermediate gear.

7. The apparatus as defined in claim 1, wherein the adjustment motor is a thrust motor which is in driving connection via a rod with one of the gears.

8. The apparatus as defined in claim 1, wherein the gears are continuously in driving connection with the adjustment motor.

9. The apparatus as defined in claim 1, wherein each of the predetermined ones of said gears possess an entrainment element cooperating with a respective lever, each said lever being connected with one of said flap members, said levers comprising at least part of said drivingly connecting means.

10. The apparatus as defined in claim 9, wherein the lever is connected via a multi-sided component with said one flap member.

11. The apparatus as defined in claim 9, wherein spring means are operatively associated with the flap members by means of which each flap member is held in one of two possible terminal positions, and wherein each flap member during one of both movements between said terminal positions is adjusted by spring force when the position of its associated entainment element permits the same.

12. The apparatus as defined in claim 1, wherein two flap members are associated with one heat exchanger, said two flap members being connected with one another by means of a rod and being simultaneously adjustable.

13. The apparatus as defined in claim 10, wherein said housing has a by-pass and the heat exchanger an outlet, and by means of at least one of said two flap members during shutting off of the outlet from the heat exchanger there is simultaneously opened the by-pass which by-passes such heat exchanger.

14. The apparatus as defined in claim 12, wherein the flap members at least during a cooling operation free a path for secondary air to both sides of a primary air compartment.

15. The apparatus as defined in claim 12, wherein said heat exchanger is a cold heat exchanger and there further is provided a hot heat exchanger, and between flap members for the cold heat exchanger and the hot heat exchanger during the total heating operation there is formed a closed compartment.

* * * * *